US010196886B2

(12) United States Patent
Tolman et al.

(10) Patent No.: US 10,196,886 B2
(45) Date of Patent: Feb. 5, 2019

(54) SELECT-FIRE, DOWNHOLE SHOCKWAVE GENERATION DEVICES, HYDROCARBON WELLS THAT INCLUDE THE SHOCKWAVE GENERATION DEVICES, AND METHODS OF UTILIZING THE SAME

(71) Applicants: Randy C. Tolman, Spring, TX (US); P. Matthew Spiecker, Manvel, TX (US); Steve Lonnes, Spring, TX (US)

(72) Inventors: Randy C. Tolman, Spring, TX (US); P. Matthew Spiecker, Manvel, TX (US); Steve Lonnes, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 203 days.

(21) Appl. No.: 15/264,076

(22) Filed: Sep. 13, 2016

(65) Prior Publication Data

US 2017/0159420 A1 Jun. 8, 2017

Related U.S. Application Data

(60) Provisional application No. 62/263,069, filed on Dec. 4, 2015.

(51) Int. Cl.
*E21B 43/263* (2006.01)
*E21B 47/09* (2012.01)
(Continued)

(52) U.S. Cl.
CPC ..... *E21B 43/263* (2013.01); *E21B 34/06* (2013.01); *E21B 43/25* (2013.01); *E21B 47/06* (2013.01);
(Continued)

(58) Field of Classification Search
CPC combination set(s) only.
See application file for complete search history.

(56) References Cited

U.S. PATENT DOCUMENTS 3,167,122 A 1/1965 Lang
3,450,203 A 6/1969 Patron et al.
(Continued)

FOREIGN PATENT DOCUMENTS

AU 2015 201029 3/2015
WO WO 2003/002849 1/2003
(Continued)

OTHER PUBLICATIONS

Halliburton, "*Illusion Frac Plug*," downloaded from http://www.halliburton.com/en-US/news/announcements/halliburton-introduces-illusion-frac-plug.page?node-id=hgeystis, Jun. 15, 2015, p. 1.

*Primary Examiner* — Catherine Loikith
(74) *Attorney, Agent, or Firm* — ExxonMobil Upstream Research Company—Law Department

(57) ABSTRACT

Select-fire, downhole shockwave generation devices, hydrocarbon wells that include the shockwave generation devices, and methods of utilizing the same are disclosed herein. The shockwave generation devices are configured to generate a shockwave within a wellbore fluid that extends within a tubular conduit of a wellbore tubular. The shockwave generation devices include a core, a plurality of explosive charges arranged on an external surface of the core, and a plurality of triggering devices. Each of the plurality of triggering devices is associated with a selected one of the plurality of explosive charges and is configured to selectively initiate explosion of the selected one of the plurality of explosive charges. The methods include methods of generating a shockwave utilizing the downhole shockwave generation devices.

29 Claims, 9 Drawing Sheets

(51) Int. Cl.

| | |
|---|---|
| ***E21B 43/25*** | (2006.01) |
| ***F42D 1/06*** | (2006.01) |
| ***E21B 47/06*** | (2012.01) |
| ***E21B 34/06*** | (2006.01) |
| ***F42B 3/00*** | (2006.01) |
| ***F42B 3/22*** | (2006.01) |
| ***F42D 1/045*** | (2006.01) |
| ***F42D 1/22*** | (2006.01) |
| *E21B 34/00* | (2006.01) |

(52) U.S. Cl.
CPC ..... *E21B 47/065* (2013.01); *E21B 47/0905* (2013.01); *F42B 3/00* (2013.01); *F42B 3/22* (2013.01); *F42D 1/045* (2013.01); *F42D 1/22* (2013.01); *E21B 2034/002* (2013.01)

(56) References Cited

U.S. PATENT DOCUMENTS

| | | | | |
|---|---|---|---|---|
| 5,234,055 | A | 8/1993 | Cornette | |
| 5,579,844 | A | 12/1996 | Rebardi et al. | |
| 5,704,426 | A | 1/1998 | Rytlewski et al. | |
| 5,829,520 | A | 11/1998 | Johnson | |
| 6,006,671 | A * | 12/1999 | Yunan | C06C 5/04 102/275.1 |
| 6,095,247 | A | 8/2000 | Streich et al. | |
| 6,155,494 | A | 12/2000 | Fabbri et al. | |
| 6,394,184 | B2 | 5/2002 | Tolman et al. | |
| 6,543,538 | B2 | 4/2003 | Tolman et al. | |
| 6,907,936 | B2 | 6/2005 | Fehr et al. | |
| 6,957,701 | B2 | 10/2005 | Tolman et al. | |
| 7,059,407 | B2 | 6/2006 | Tolman et al. | |
| 7,168,494 | B2 | 1/2007 | Starr et al. | |
| 7,353,879 | B2 | 4/2008 | Todd et al. | |
| 7,357,151 | B2 | 4/2008 | Lonnes et al. | |
| 7,467,778 | B2 | 12/2008 | Lonnes | |
| 7,477,160 | B2 | 1/2009 | Lemenager et al. | |
| 7,516,792 | B2 | 4/2009 | Lonnes et al. | |
| 7,575,062 | B2 | 8/2009 | East, Jr. | |
| 7,735,559 | B2 | 6/2010 | Malone | |
| 7,798,236 | B2 | 9/2010 | McKeachnie et al. | |
| 8,167,047 | B2 | 5/2012 | Themig et al. | |
| 8,215,411 | B2 | 7/2012 | Flores et al. | |
| 8,220,542 | B2 | 7/2012 | Whitsitt et al. | |
| 8,237,585 | B2 | 8/2012 | Zimmerman | |
| 8,267,177 | B1 | 9/2012 | Vogel et al. | |
| 8,276,670 | B2 | 10/2012 | Patel | |
| 8,330,617 | B2 | 12/2012 | Chen et al. | |
| 8,347,982 | B2 | 1/2013 | Hannegan et al. | |
| 8,496,055 | B2 | 7/2013 | Mootoo et al. | |
| 8,695,506 | B2 | 4/2014 | Lanclos | |
| 2002/0007949 | A1 | 1/2002 | Tolman et al. | |
| 2004/0084190 | A1 | 5/2004 | Hill et al. | |
| 2006/0118301 | A1 | 6/2006 | East, Jr. et al. | |
| 2008/0093073 | A1 | 4/2008 | Bustos et al. | |
| 2008/0156498 | A1 | 7/2008 | Phi et al. | |
| 2008/0296024 | A1 | 12/2008 | Huang et al. | |
| 2009/0032255 | A1 | 2/2009 | Surjaatmadja et al. | |
| 2009/0101334 | A1 | 4/2009 | Baser et al. | |
| 2010/0084134 | A1 | 4/2010 | Tulissi et al. | |
| 2010/0122817 | A1 | 5/2010 | Surjaatmadja et al. | |
| 2011/0048743 | A1 | 3/2011 | Stafford et al. | |
| 2011/0168403 | A1 | 7/2011 | Patel | |
| 2012/0037366 | A1 | 2/2012 | Sherman | |
| 2012/0043079 | A1 | 2/2012 | Wassouf et al. | |
| 2012/0085548 | A1 | 4/2012 | Fleckenstein et al. | |
| 2012/0090687 | A1 | 4/2012 | Grigsby et al. | |
| 2012/0111566 | A1 | 5/2012 | Sherman et al. | |
| 2012/0199349 | A1 | 8/2012 | Themig et al. | |
| 2012/0292053 | A1 | 11/2012 | Xu et al. | |
| 2013/0008648 | A1 | 1/2013 | Lovorn et al. | |
| 2013/0062055 | A1 | 3/2013 | Tolman et al. | |
| 2013/0062072 | A1 | 3/2013 | Alvarez et al. | |
| 2013/0105159 | A1 | 5/2013 | Alvarez et al. | |
| 2013/0199790 | A1 | 8/2013 | Themig et al. | |
| 2013/0206425 | A1 | 8/2013 | Mazyar et al. | |
| 2013/0248174 | A1 | 9/2013 | Dale et al. | |
| 2013/0255939 | A1 | 10/2013 | Kumaran et al. | |
| 2014/0131035 | A1 | 5/2014 | Entchev et al. | |
| 2014/0305877 | A1 | 10/2014 | Cioanta et al. | |
| 2015/0176388 | A1 | 6/2015 | Tolman et al. | |
| 2015/0252640 | A1 * | 9/2015 | Mailand | E21B 33/12 166/386 |
| 2015/0315872 | A1 | 11/2015 | Phi et al. | |

FOREIGN PATENT DOCUMENTS

| | | |
|---|---|---|
| WO | WO 2007/115051 | 10/2007 |
| WO | WO 2007/134598 | 11/2007 |
| WO | WO 2014/077949 | 5/2014 |
| WO | WO 2014/184587 | 11/2014 |
| WO | WO 2015/073030 | 5/2015 |

* cited by examiner

SELECT-FIRE, DOWNHOLE SHOCKWAVE GENERATION DEVICES, HYDROCARBON WELLS THAT INCLUDE THE SHOCKWAVE GENERATION DEVICES, AND METHODS OF UTILIZING THE SAME

CROSS REFERENCE TO RELATED APPLICATIONS

This application claims the benefit of U.S. Provisional Application Ser. No. 62/263,069 filed Dec. 4, 2015, entitled "Select-Fire, Downhole Shockwave Generation Devices, Hydrocarbon Wells That Include The Shockwave Generation Devices, and Methods to of Utilizing the Same," the entirety by which is incorporated by reference herein.

This application is related to U.S. Provisional Application Ser. No. 62/262,034 filed Dec. 2, 2015, entitled, "Selective Stimulation Ports, Wellbore Tubulars That Include Selective Stimulation Ports, and Methods of Operating the Same,"; U.S. Provisional Application Ser. No. 62/262,036 filed Dec. 2, 2015, entitled, "Wellbore Tubulars Including A Plurality of Selective Ports and Methods of Utilizing the Same,"; U.S. Provisional Application Ser. No. 62/263,065 filed Dec. 4, 2015, entitled, "Wellbore Ball Sealer and Methods of Utilizing the Same,"; U.S. Provisional Application Ser. No. 62/263,067 filed Dec. 4, 2015, entitled, "Ball-Sealer Check-Valves for Wellbore Tubulars and Methods of Utilizing the Same,"; and U.S. Provisional Application Ser. No. 62/329,690 filed Apr. 29, 2016, entitled, "System and Method for Autonomous Tools,", the disclosures of which are incorporated herein by reference in their entireties.

FIELD OF THE DISCLOSURE

The present disclosure is directed to select-fire, downhole shockwave generation devices, to hydrocarbon wells that include the downhole shockwave generation devices, and to methods of utilizing the downhole shockwave generation devices and/or the hydrocarbon wells.

BACKGROUND OF THE DISCLOSURE

Hydrocarbon wells generally include a wellbore that extends from a surface region and/or that extends within a subterranean formation that includes a reservoir fluid, such as liquid and/or gaseous hydrocarbons. Often, it may be desirable to stimulate the subterranean formation to enhance production of the reservoir fluid therefrom. Stimulation of the subterranean formation may be accomplished in a variety of ways and generally includes supplying a stimulant fluid to the subterranean formation to increase reservoir contact. As an example, the stimulation may include supplying an acid to the subterranean formation to acid-treat the subterranean formation and/or to dissolve at least a portion of the subterranean formation. As another example, the stimulation may include fracturing the subterranean formation, such as by supplying a fracturing fluid, which is pumped at a high pressure, to the subterranean formation. The fracturing fluid may include particulate material, such as a proppant, which may at least partially fill fractures that are generated during the fracturing, thereby facilitating fluid flow within the fractures after supply of the fracturing fluid has ceased.

A variety of systems and/or methods have been developed to facilitate stimulation of subterranean formations, and each of these systems and methods generally has inherent benefits and drawbacks. These systems and methods often utilize a shape charge perforation gun to create perforations within a casing string that extends within the wellbore, and the stimulant fluid then is provided to the subterranean formation via the perforations. However, such systems suffer from a number of limitations. As an example, the perforations may not be round or may have burrs, which may make it challenging to seal the perforations subsequent to stimulating a given region of the subterranean formation. As another example, the perforations often will erode and/or corrode due to flow of the stimulant fluid, flow of proppant, and/or long-term flow of reservoir fluid therethrough. This may make it challenging to seal the perforations and/or may change fluid flow characteristics therethrough. These challenges may occur early in the life of the hydrocarbon well, such as during and/or after completion thereof, and/or later in the life of the hydrocarbon well, such as after production of the reservoir fluid with the hydrocarbon well and/or during and/or after restimulation of the hydrocarbon well. As yet another example, it may be challenging to precisely locate, size, and/or orient perforations, which are created utilizing the shape charge perforation gun, within the casing string. Thus, there exists a need for alternative mechanisms via which fluid communication selectively may be established between a casing conduit of the casing string and the subterranean formation.

SUMMARY OF THE DISCLOSURE

Select-fire, downhole shockwave generation devices, hydrocarbon wells that include the shockwave generation devices, and methods of utilizing the same are disclosed herein. The shockwave generation devices are configured to generate a shockwave within a wellbore fluid that extends within a tubular conduit of a wellbore tubular. The shockwave generation devices include a core, a plurality of explosive charges arranged on an external surface of the core, and a plurality of triggering devices. Each of the plurality of triggering devices is associated with a selected one of the plurality of explosive charges and is configured to selectively initiate explosion of the selected one of the plurality of explosive charges.

The methods include methods of generating a shockwave utilizing the downhole shockwave generation devices. The methods include positioning the downhole shockwave generation device within a first region of the tubular conduit and actuating a first triggering device. The first triggering device initiates explosion of a first explosive charge and generates a first shockwave within the first region of the tubular conduit. The methods further include moving the shockwave generation device to a second region of the tubular conduit that is spaced-apart from the first region of the tubular conduit and actuating a second triggering device. The second triggering device initiates explosion of a second explosive charge and generates a second shockwave within the second region of the tubular conduit. Each shockwave may cause one or more selective stimulation ports present in the wellbore tubular to transition from a closed state to an open state, such as if the shockwave intensity exceeds a threshold shockwave intensity at the one or more selective stimulation ports. Once opened by the shockwave from the downhole shockwave generation device, the selective stimulation ports may permit fluid flow between the wellbore tubular and the subterranean formation.

DETAILED DESCRIPTION AND BEST MODE OF THE DISCLOSURE

Figure 1:
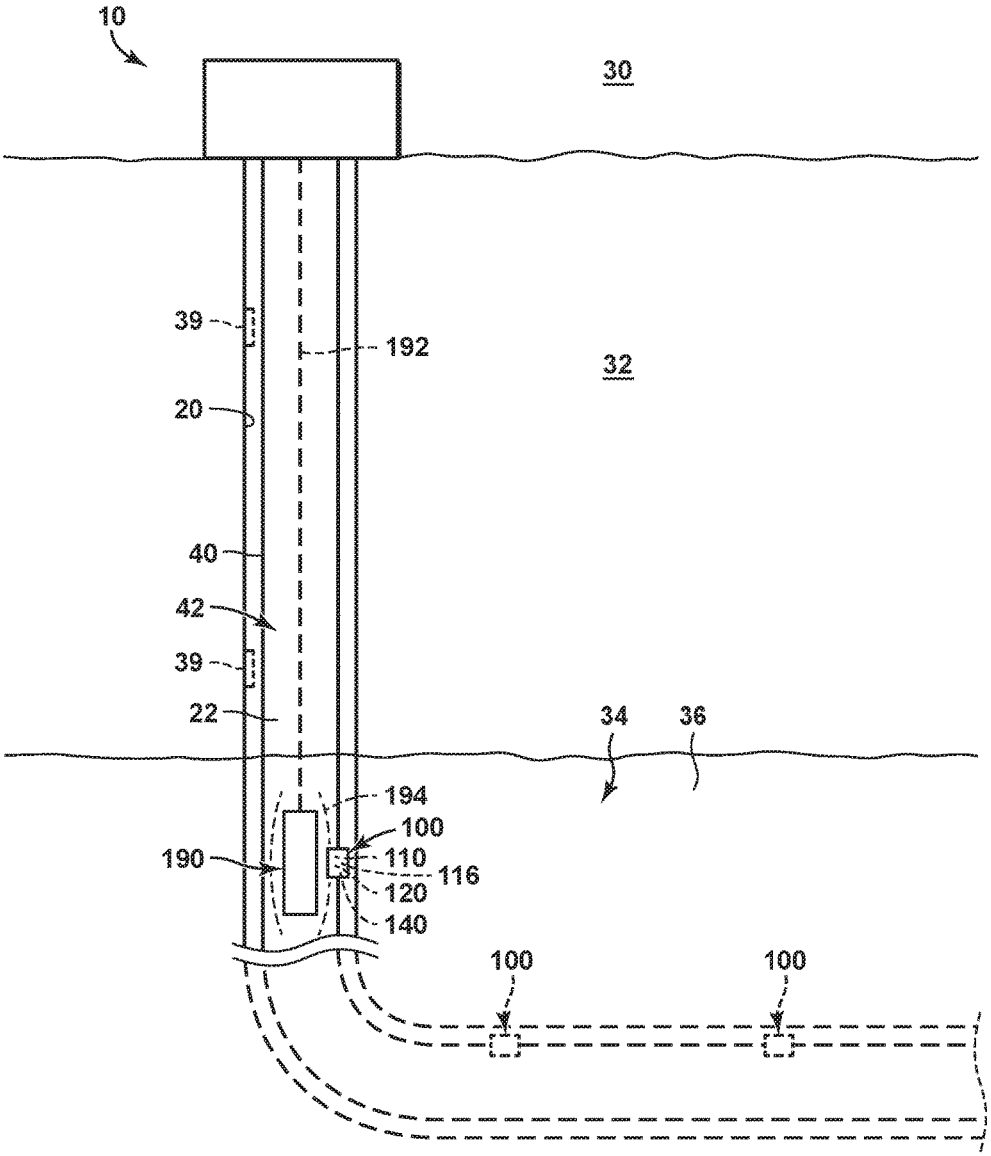
FIG. 1 is a schematic representation of a hydrocarbon well that may include and/or utilize a shockwave generation device according to the present disclosure.

FIGS. 1-14 provide examples of shockwave generation devices 190, according to the present disclosure, of hydrocarbon wells 10 that may include and/or utilize shockwave generation devices 190, and/or of methods 800 of utilizing shockwave generation devices 190. Elements that serve a similar, or at least substantially similar, purpose are labeled with like numbers in each of FIGS. 1-14, and these elements may not be discussed in detail herein with reference to each of FIGS. 1-14. Similarly, all elements may not be labeled in each of FIGS. 1-14, but reference numerals associated therewith may be utilized herein for consistency. Elements, components, and/or features that are discussed herein with reference to one or more of FIGS. 1-14 may be included in and/or utilized with any of FIGS. 1-14 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic representation of a hydrocarbon well 10 that may include and/or utilize a shockwave generation device 190 according to the present disclosure. Hydrocarbon well 10 includes a wellbore 20 that extends from a surface region 30, within a subsurface region 32, within a subterranean formation 34 of subsurface region 32, and/or between the surface region and the subterranean formation. Subterranean formation 34 includes a reservoir fluid 36, such as a liquid hydrocarbon and/or a gaseous hydrocarbon, and hydrocarbon well 10 may be utilized to produce, pump, and/or convey the reservoir fluid from the subterranean formation and/or to the surface region. Wellbore 20 may include and/or be a vertical wellbore, as illustrated in solid lines in FIG. 1. Additionally or alternatively, and as illustrated in dashed lines, wellbore 20 also may include and/or be a horizontal wellbore 20 and/or a deviated wellbore 20.

Hydrocarbon well 10 further includes wellbore tubular 40, which extends within wellbore 20 and defines a tubular conduit 42. Wellbore tubular 40 includes a plurality of selective stimulation ports (SSPs) 100. SSPs 100 are illustrated in dashed lines in FIG. 1 to indicate that the SSPs may be operatively attached to and/or may form a portion of any suitable component of wellbore tubular 40. SSPs 100 may be configured to be operatively attached to wellbore tubular 40 prior to the wellbore tubular being located, placed, and/or installed within wellbore 20.

SSPs 100 may be operatively attached to wellbore tubular 40 in any suitable manner. As examples, SSPs 100 may be operatively attached to wellbore tubular 40 via one or more of a threaded connection, a glued connection, a press-fit connection, a welded connection, and/or a brazed connection.

As also illustrated in FIG. 1, hydrocarbon well 10 also includes and/or has associated therewith shockwave generation device 190. Shockwave generation device 190 may be configured to generate a shockwave 194 within a wellbore fluid 22 that extends within tubular conduit 42, as discussed in more detail herein. The shockwave propagates within the wellbore fluid and/or propagates from the shockwave generation device to the selective stimulation port within and/or via the wellbore fluid.

In addition, the shockwave is attenuated by the wellbore fluid, and this attenuation may include attenuation by at least a threshold attenuation rate. As an example, the shockwave may have a peak shockwave intensity proximate the shockwave generation device and may decay, or decrease in intensity, with distance from the shockwave generation device. Under these conditions, the threshold shockwave intensity may be less than a threshold fraction of the peak shockwave intensity. Examples of the threshold attenuation rate include attenuation rates of at least 1 megapascal per meter (MPa/m), at least 2 MPa/m, at least 4 MPa/m, at least 6 MPa/m, at least 8 MPa/m, at least 10 MPa/m, at least 12 MPa/m, at least 14 MPa/m, at least 16 MPa/m, at least 18 MPa/m, and/or at least 20 MPa/m.

SSPs 100 are configured to selectively transition from a closed state, in which fluid flow therethrough (i.e., between the tubular conduit and the subterranean formation) is blocked, restricted, and/or occluded, to an open state, in which fluid flow therethrough is permitted, responsive to receipt of, or responsive to experiencing, a shockwave of greater than a threshold shockwave intensity. As an example, and as illustrated in dashed lines in FIG. 1, SSPs 100 may include an SSP body 110 that defines an SSP conduit 116, which extends between tubular conduit 42 and wellbore 20 and/or between tubular conduit 42 and subterranean formation 34. SSPs 100 further may include an isolation device 120 and a sealing device seat 140.

Isolation device 120 may include an isolation disk that extends across SSP conduit 116 when the SSP is in the closed state and that separates from SSP body 110 responsive to receipt of the shockwave with greater than the threshold shockwave intensity, such as to permit fluid flow through SSP conduit 116 when the SSP is in the open state. Additionally or alternatively, isolation device 120 may include a frangible disk that extends across SSP conduit 116 when the SSP is in the closed state and that breaks apart responsive to receipt of the shockwave with greater than the threshold shockwave intensity, such as to permit fluid flow through SSP conduit 116 when the SSP is in the open state.

Sealing device seat 140 may extend within tubular conduit 42 and may be shaped to form a fluid seal with a sealing device, such as a ball sealer, that flows into engagement with the sealing device seat. Formation of the fluid seal may selectively restrict fluid flow from tubular conduit 42 and into wellbore 20 and/or subterranean formation 34 via SSP conduit 116.

Sealing device seat 140 may be a preformed sealing device seat that has a predetermined geometry prior to wellbore tubular 40 being located within wellbore 20. Additionally or alternatively, sealing device seat 140 may include and/or be a corrosion-resistant sealing device seat and/or an erosion-resistant, or abrasion-resistant, sealing device seat.

Since shockwave 194 is attenuated by wellbore fluid 22, the shockwave may have sufficient energy (i.e., may have greater than the threshold shockwave intensity) to transition a first SSP 100, which is less than a threshold distance from the shockwave generation device when the shockwave generation device generates the shockwave, from the closed state to the open state. However, the shockwave may have insufficient energy to transition a second SSP 100, which is greater than the threshold distance from the shockwave generation device when the shockwave generation device generates the shockwave, from the closed state to the open state.

Stated another way, the plurality of explosive charges may be sized such that the shockwave selectively transitions the first SSP from the closed state to the open state but does not transition the second SSP from the closed state to the open state. The threshold distance also may be referred to herein as a maximum effective distance of the shockwave and/or of the shockwave generation device 190 from which the shockwave was generated. Examples of the threshold distance include threshold distances of less than 1 meter, less than 2 meters, less than 3 meters, less than 4 meters, less than 5 meters, less than 6 meters, less than 7 meters, less than 8 meters, less than 10 meters, less than 15 meters, less than 20 meters, or less than 30 meters along a length of the tubular conduit.

Shockwave generation device 190 may include and/or be any suitable structure that may, or may be utilized to, generate the shockwave within wellbore fluid 22. As an example, shockwave generation device 190 may be an umbilical-attached shockwave generation device 190 that may be operatively attached to, or may be positioned within tubular conduit 42 via, an umbilical 192, such as a wireline, a tether, tubing, jointed tubing, and/or coiled tubing. As another example, shockwave generation device 190 may be an autonomous shockwave generation device that may be flowed into and/or within tubular conduit 42 without an attached umbilical. When shockwave generation device 190 is an autonomous shockwave generation device, hydrocarbon well 10 further may include a wireless downhole communication network 39, which may be configured to wirelessly communicate with shockwave generation device 190, such as to convey one or more status signals from the shockwave generation device to the surface region and/or to convey one or more control signals from the surface region to the shockwave generation device.

Figure 2:
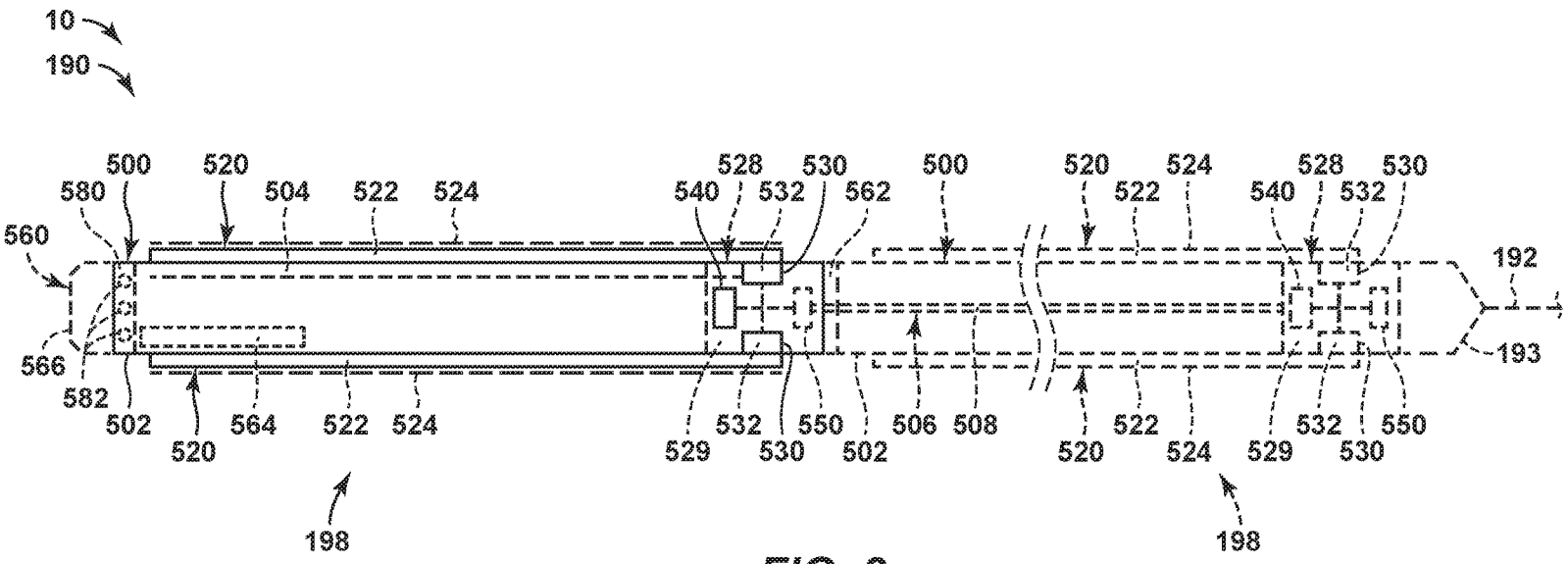
FIG. 2 is a schematic representation of shockwave generation devices according to the present disclosure.
Figure 3:
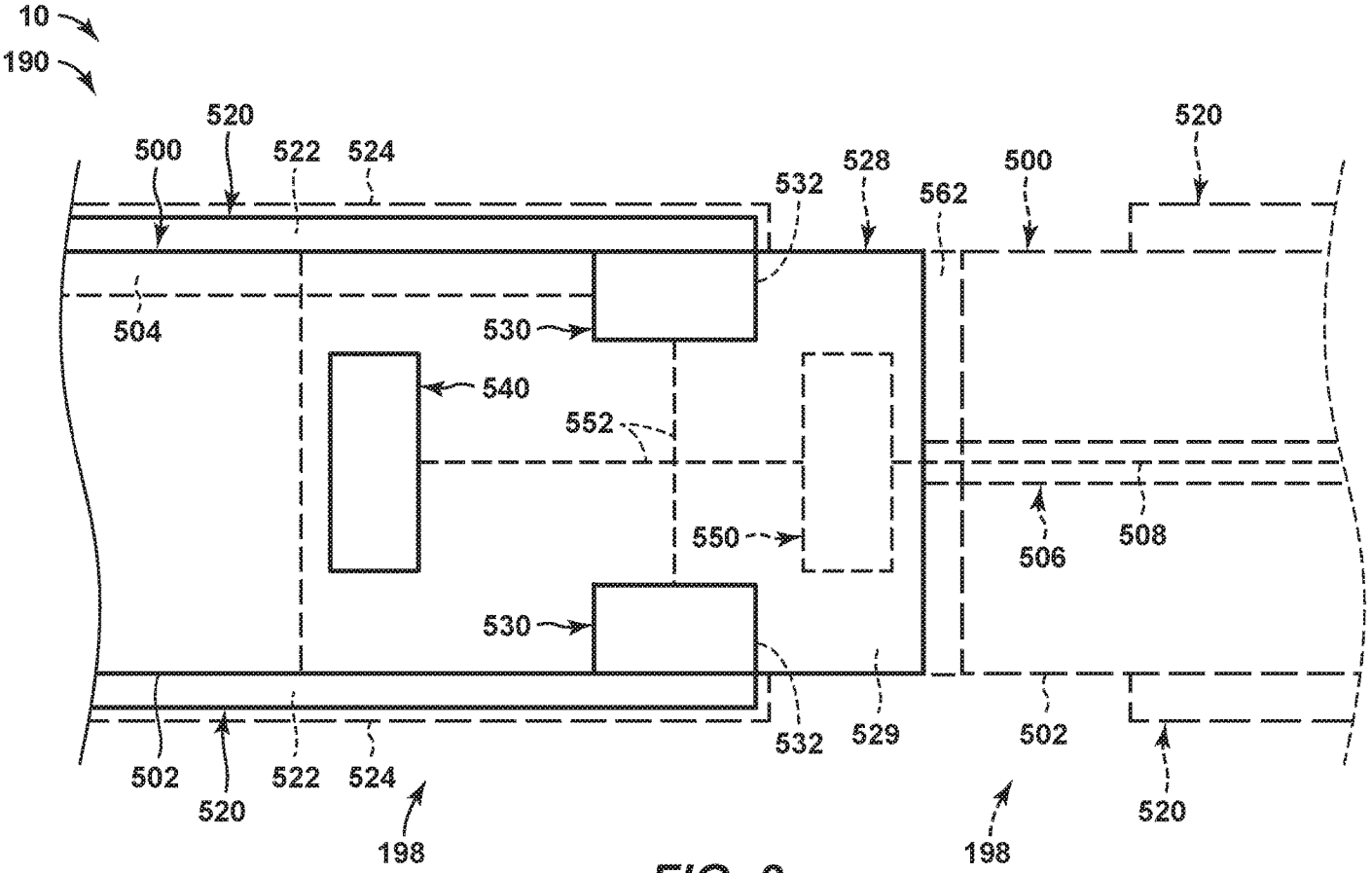
FIG. 3 is a more detailed but still schematic representation of a portion of the shockwave generation devices of FIG. 2.
Figure 4:
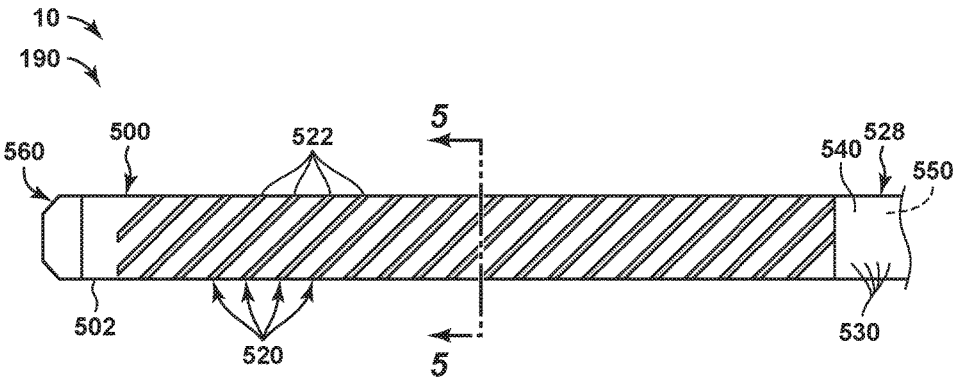
FIG. 4 is a less schematic side view of a shockwave generation device according to the present disclosure.
Figure 5:
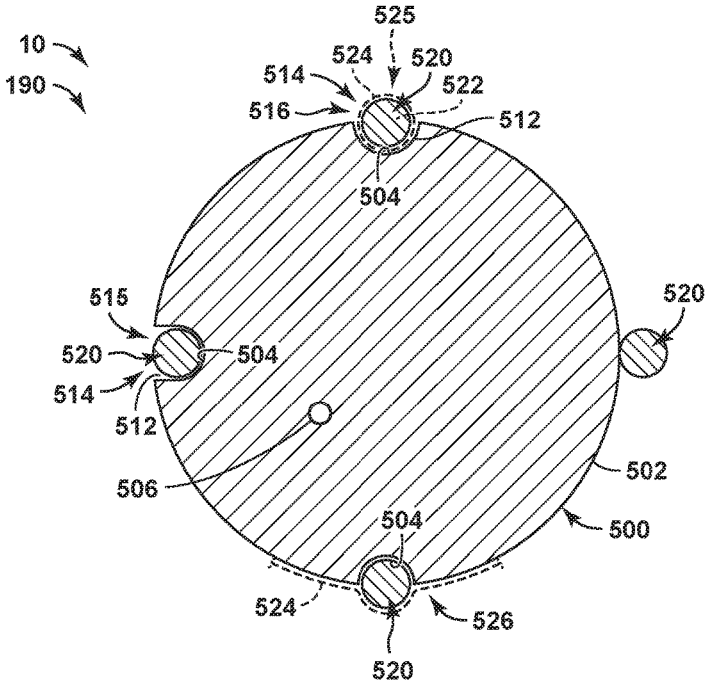
FIG. 5 is a cross-sectional view of the shockwave generation device of FIG. 4 taken along line 5-5 of FIG. 5 and showing examples of flutes and protective barriers that may be included in shockwave generation devices according to the present disclosure.
Figure 6:
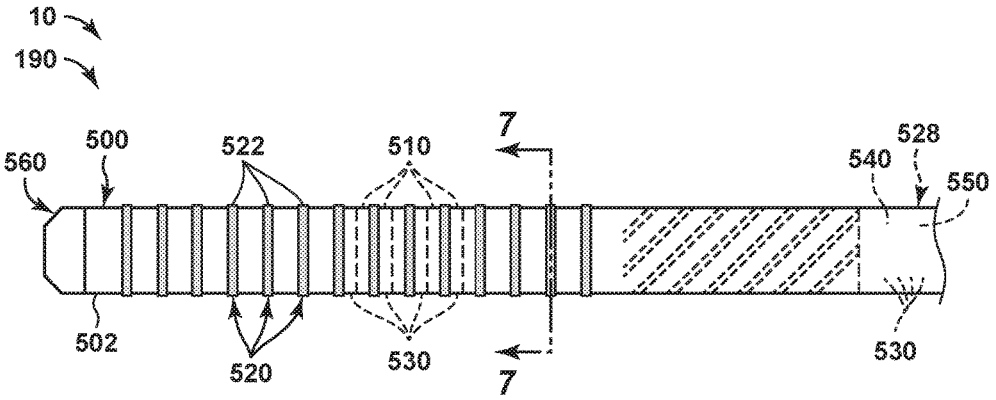
FIG. 6 is a less schematic side view of another shockwave generation device according to the present disclosure.
Figure 7:
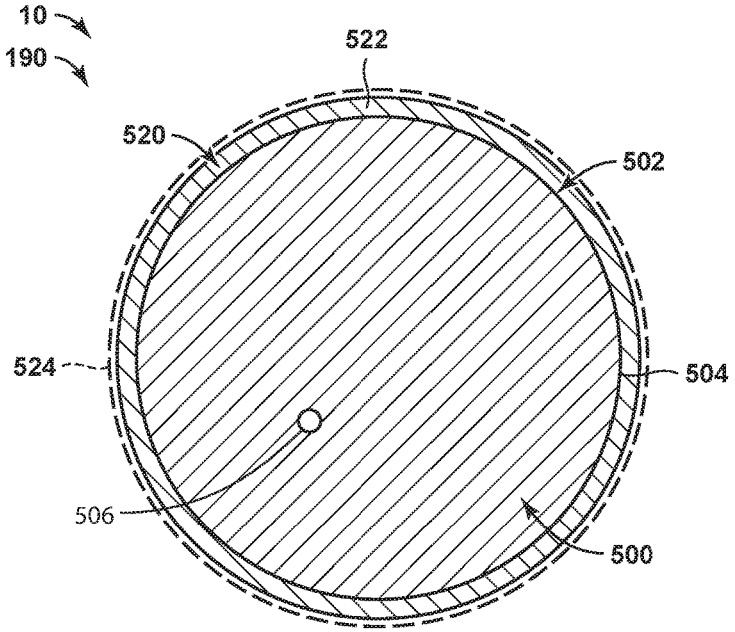
FIG. 7 is a cross-sectional view of the shockwave generation device of FIG. 6 taken along line 7-7 of FIG. 6.
Figure 8:
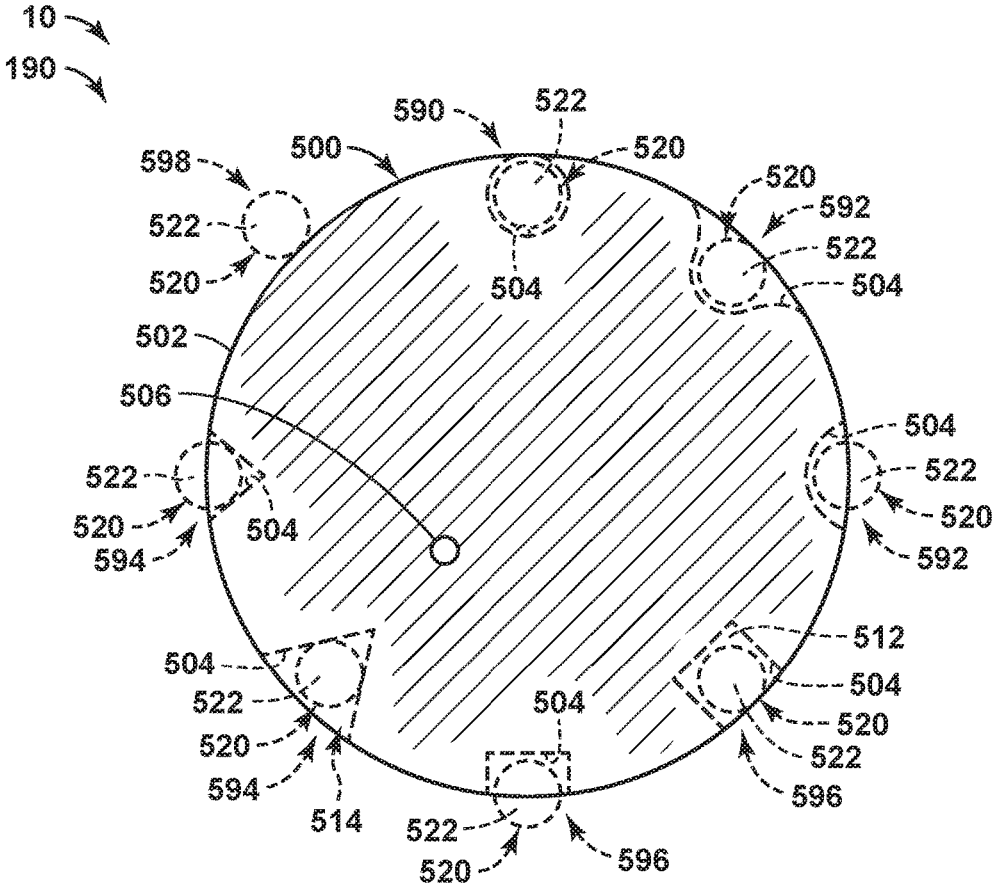
FIG. 8 illustrates examples of various transverse cross-sectional shapes for flutes that may be defined by a core of a shockwave generation device according to the present disclosure.

FIG. 2 is a schematic representation of a shockwave generation device 190 according to the present disclosure, while FIG. 3 is a more detailed but still schematic representation of a portion of the shockwave generation device of FIG. 2. FIG. 4 is a less schematic side view of a shockwave generation device 190 according to the present disclosure, while FIG. 5 is a cross-sectional view of the shockwave generation device of FIG. 4 taken along line 5-5 of FIG. 4. FIG. 5 illustrates various relative shapes and orientations for flutes, explosive charges, and protective barriers that may be utilized in shockwave generation devices. FIG. 6 is a less schematic side view of another shockwave generation device 190 according to the present disclosure, while FIG. 7 is a cross-sectional view of the shockwave generation device of FIG. 6 taken along line 7-7 of FIG. 6. FIG. 8 illustrates various transverse cross-sectional shapes for flutes 504 that may be defined by a core 500 of a shockwave generation device 190 according to the present disclosure.

Shockwave generation devices 190 of FIGS. 2-8 may include and/or be a more detailed example of shockwave generation device 190 of FIG. 1, and any of the structures, functions, and/or features that are discussed herein with reference to shockwave generation devices 190 of FIGS. 2-8 may be included in and/or utilized with shockwave generation device 190 and/or hydrocarbon well 10 of FIG. 1 without departing from the scope of the present disclosure. Similarly, any of the structures, functions, and/or features that are discussed herein with reference to shockwave generation device 190 and/or hydrocarbon well 10 of FIG. 1 may be included in and/or utilized with shockwave generation devices 190 of FIGS. 2-8 without departing from the scope of the present disclosure.

As illustrated in FIG. 1, shockwave generation device 190 is configured to generate shockwave 194 within wellbore fluid 22 that extends within tubular conduit 42 of wellbore tubular 40. As illustrated in FIGS. 2-8, shockwave generation devices 190 include a core 500 and a plurality of explosive charges 520. As illustrated in FIGS. 2-4 and 6, shockwave generation devices 190 further include a plurality of triggering devices 530.

Explosive charges 520 are arranged on an external surface 502 of core 500, and each triggering device 530 is configured to initiate explosion of a selected one of the plurality of explosive charges 520. Stated another way, shockwave generation device 190 may be configured such that a selected triggering device 530 may initiate explosion of a selected explosive charge 520 without initiating explosion of other explosive charges 520 that may be associated with other triggering devices 530. As such, shockwave generation device 190 also may be referred to herein as, or may be, a select-fire shockwave generation device 190, a selective-fire, downhole shockwave generation device 190, and/or a shockwave generation device 190 that is configured to selectively explode a plurality of explosive charges 520 and/or to generate a plurality of shockwaves that are spaced-apart in time.

It is within the scope of the present disclosure that the phrase "selected one of the plurality of explosive charges" may refer to a single explosive charge 520. Alternatively, it is also within the scope of the present disclosure that the phrase "selected one of the plurality of explosive charges" may refer to two or more spaced-apart, separate, and/or distinct explosive charges 520 and also may be referred to herein as a selected portion, a selected fraction, and/or a selected subset of the plurality of explosive charges. Thus, a given triggering device 530 may initiate explosion of a single explosive charge 520 and/or of a subset of the plurality of explosive charges 520. Regardless of the exact configuration, each triggering device 530 may initiate explosion of one or more selected and/or predetermined explosive charges 520 but may not initiate explosion of each, or every, explosive charge that is included within shockwave generation device 190.

Shockwave generation device 190 may be configured such that the shockwave emanates symmetrically, at least substantially symmetrically, isotropically, and/or at least substantially isotropically, therefrom. Stated another way, the shockwave generation device may be configured such that the shockwave is symmetric, at least substantially symmetric, isotropic, and/or at least substantially isotropic within a given transverse cross-section of the wellbore tubular in which the shockwave in generated. This symmetric and/or isotropic behavior of the shockwave may be accomplished in any suitable manner. As an example, and as discussed in more detail herein, explosive charges 520 may be wrapped around, or at least substantially around, core 500 and/or external surface 502 thereof.

Core 500 may include any suitable structure and/or material that may have, form, and/or define external surface 502, that may support explosive charges 520, and/or that may support triggering devices 530. As examples, core 500 may include and/or be an elongate core, a rigid core, a metallic core, a solid core, an elongate rigid core, and/or a metallic rod. It is within the scope of the present disclosure that core 500 may be solid, at least substantially solid, may not be tubular, does not fully enclose the plurality of explosive charges, and/or may not define a void space therewithin.

Additionally or alternatively, it is also within the scope of the present disclosure that core 500 may have and/or define one or more pass-through holes 506, as illustrated in FIGS. 2-3, 5, and 7-8. Pass-through holes 506 may extend along a longitudinal length of core 500, and a communication linkage 508 may extend therein, as illustrated in FIGS. 2-3. Communication linkage 508 may permit and/or provide communication between one or more components of shockwave generation device 190 and/or between umbilical 192 and one or more components of shockwave generation device 190.

As illustrated in FIGS. 2-3, 5, and 7-8, core 500 further may have, include, and/or define one or more flutes 504. Flutes 504 also may be referred to herein as channels 504 and/or grooves 504 and may be defined by external surface 502. In addition, flutes 504 may be shaped and/or configured to receive and/or contain one or more explosive charges 520. As an example, each flute 504 may receive and/or contain at least a portion, a majority, or even an entirety, of a respective one of the plurality of explosive charges 520.

As illustrated in FIGS. 5 and 8, each flute 504 includes a respective recess 512 and a respective opening 514. Both the opening and the recess are defined by core 500, and the opening provides, or is sized to provide, access to the recess by the respective one of the plurality of explosive charges 520. Recesses 512 may include and/or be elongate recesses that may extend along the longitudinal length of core 500, that may extend about and/or around core 500, that may spiral around core 500, and/or that may extend circumferentially around a transverse cross-section of core 500. Similarly, openings 514 may include and/or be elongate openings that may extend along the longitudinal length of core 500, that may extend about and/or around core 500, that may spiral around core 500, and/or that may extend circumferentially around a transverse cross-section of core 500.

As an example, and as illustrated in FIGS. 2-3, flutes 504 may extend longitudinally along the longitudinal length of core 500. As another example, and as illustrated in FIGS. 4-5, flutes 504 may include a plurality of spiraling flutes that wraps around external surface 502 and/or that spirals along a longitudinal axis of core 500. As yet another example, and as illustrated in FIGS. 6-7, flutes 504 may include a plurality of circumferential flutes that extends at least partially, or even completely, around the transverse cross-section of the core and may include corresponding circumferential explosive charges 520.

It is within the scope of the present disclosure that flutes 504 may at least partially, or even completely, house and/or contain respective explosive charges 520. As an example, and as illustrated in FIG. 5 at 515, a respective explosive charge 520 may extend within recess 512 and may not extend and/or project through and/or across opening 514. Stated another way, a given explosive charge may have and/or define a respective transverse cross-sectional area, a given flute, which receives the given explosive charge, may have and/or define a respective transverse cross-sectional area, and the respective transverse cross-sectional area of the given explosive charge may be less than the respective transverse cross-sectional area of the given flute.

Such a configuration may be utilized to protect the explosive charge from damage due to motion of the shockwave generation device within the tubular conduit and/or due to flow of an abrasive material past the shockwave generation device while the shockwave generation device is present within the tubular conduit. Additionally or alternatively, such a configuration may provide a desired level of focusing, a desired intensity, and/or a desired directionality of the shockwave that is generated responsive to explosion of the given explosive charge.

A given flute 504 additionally or alternatively may be shaped and/or otherwise configured to protect a given explosive charge 520 such that initiation of explosion of another, or an adjacent, explosive charge 520 does not initiate explosion of the given explosive charge 520. As examples, the given flute 504 may direct the shockwave that is generated by given explosive charge 520 away from core 500, may direct the shockwave away from the other flutes 504, and/or may direct the shockwave away from other explosive charges 520 that are associated with the other flutes 504. As additional examples, the given flute 504 and/or the adjacent flute(s) may be configured to sufficiently shield and/or isolate the adjacent explosive charges from the shockwave produced by the given explosive charge 520 to prevent the shockwave from the given explosive charge initiating explosion of the adjacent explosive charges. Such configurations may permit and/or facilitate each triggering device 520 to initiate explosion of one or more selected explosive charges 520 without initiating explosion of each, or every, explosive charge that is included within shockwave generation device 190, as discussed in more detail herein.

As another example, and as illustrated in FIG. 5 at 516, a respective explosive charge 520 may extend within recess 512 and also may extend and/or project through and/or across opening 514. Stated another way, the respective transverse cross-sectional area of the given charge may be less than the respective transverse cross-sectional area of the given flute. Such a configuration may provide a desired level of focusing, a desired intensity, and/or a desired directionality of the shockwave that is generated responsive to explosion of the given explosive charge.

As discussed, core 500 and/or external surface 502 thereof may define one or more flutes 504. It is within the scope of the present disclosure that flutes 504 may have and/or define any suitable cross-sectional, or transverse cross-sectional, shape. As an example, and as illustrated in FIG. 5 and in FIG. 8 at 590, flutes 504 may have and/or define a circular, or at least partially circular, transverse cross-sectional shape. As another example, and as illustrated in FIG. 8 at 592, flutes 504 may have and/or define an arcuate, or at least partially arcuate, transverse cross-sectional shape. As yet another example, and as illustrated in FIG. 8 at 594, flutes 504 may have and/or define a triangular, at least partially triangular, V-shaped, or at least partially V-shaped, transverse cross-sectional shape. As another example, and as illustrated in FIG. 8 at 596, flutes 504 may have and/or define a square, at least partially square, rectangular, or at least partially rectangular, transverse cross-sectional shape. Flutes with other regular and/or irregular geometric transverse cross-sectional shapes also may be utilized. Additionally or alternatively, and as discussed herein and illustrated in FIG. 8 at 598, one or more explosive charges 520 may extend across a portion of external surface 502 that does not include a flute.

Core 500 may be a single-piece and/or monolithic structure. Alternatively, and as illustrated in dashed lines in FIG. 6, core 500 may be a multi-piece core that includes a plurality of core segments 510. Under these conditions, each core segment 510 may be operatively attached to one or more adjacent core segments to form and/or define core 500. When shockwave generation device 190 includes core segments 510, it is within the scope of the present disclosure that each core segment 510 may have any suitable number of explosive charges 520 and/or corresponding triggering devices 530 associated therewith and/or attached thereto. As examples, each core segment may have 1, 2, 3, 4, 5, 6, 7, 8, or more than 8 explosive charges and/or corresponding triggering devices associated therewith and/or attached thereto.

Explosive charges 520 may include and/or be any suitable structure that may be adapted, configured, formulated, synthesized, and/or constructed to selectively explode and/or to selectively generate the shockwave within the wellbore fluid. An example of explosive charges 520 includes a primer cord 522. As an example, shockwave generation device 190 may include a plurality of lengths of primer cord 522, with each explosive charge 520 including at least one length of primer cord. Primer cord 522 also may be referred to herein as a detonation cord 522 and/or as a detonating cord 522 and may be configured to explode and/or detonate.

When shockwave generation device 190 and/or explosive charges 520 thereof include primer cord 522, the primer cord may have and/or define any suitable length. As examples, the length of the primer cord may be at least 0.1 meter (m), at least 0.2 m, at least 0.3 m, at least 0.4 m, at least 0.5 m, at least 0.6 m, at least 0.7 m, at least 0.8 m, at least 0.9 m, at least 1 m, at least 1.25 m, at least 1.5 m, at least 1.75 m, or at least 2 m. Additionally or alternatively, the length of the primer cord may be less than 5 m, less than 4.5 m, less than 4 m, less than 3.5 m, less than 3 m, less than 2.5 m, less than 2 m, less than 1.5 m, or less than 1 M.

Primer cord 522 also may include any suitable amount of an explosive, such as gunpowder. As examples, the primer cord may include at least 25 grains of gunpowder per meter of length (grains/m), at least 50 grains/m, at least 100 grains/m, at least 150 grains/m, at least 200 grains/m, at least 300 grains/m, at least 400 grains/m, at least 500 grains/m, or at least 600 grains/m. Additionally or alternatively, the primer cord may include fewer than 1000 grains/m, fewer than 900 grains/m, fewer than 800 grains/m, fewer than 700 grains/m, fewer than 600 grains/m, fewer than 500 grains/m, fewer than 400 grains/m, fewer than 300 grains/m, or fewer than 200 grains/m. The amount of explosive, or gunpowder, also may be expressed in grams per meter of length (g/m). As examples, the primer cord may include at least 1.6 g/m, at least 3.3 g/m, at least 6.5 g/m, at least 9.8 g/m, at least 13 g/m, at least 19.5 g/m, at least 26 g/m, at least 32.5 g/m, or at least 39 g/m. Additionally or alternatively, the primer cord may include fewer than 65 g/m, fewer than 58.5 g/m, fewer than 52 g/m, fewer than 45.5 g/m, fewer than 39 g/m, fewer than 32.5 g/m, fewer than 26 g/m, fewer than 19.5 g/m, or fewer than 13 g/m.

In general, the length of the primer cord and/or the amount of explosive per unit length of the primer cord may be selected to provide a desired intensity, or a desired maximum intensity, for the shockwave when the primer cord explodes within the wellbore fluid. As an example, the length of the primer cord and/or the amount of explosive per unit length of the primer cord may be selected such that the maximum intensity of the shockwave is greater than the threshold shockwave intensity necessary to transition selective stimulation port 100 of FIG. 1 from the closed state to the open state. As another example, the length of the primer cord and/or the amount of explosive charge per unit length of the primer cord may be selected such that maximum intensity of the shockwave is less than an intensity that would damage, or rupture, a wellbore tubular that defines a tubular conduit within which the shockwave is generated and/or such that the shockwave has insufficient energy, or intensity, to rupture or damage the wellbore tubular.

Stated another way, each explosive charge 520 may be sized such that the shockwave has a maximum pressure of at least 100 megapascals (MPa), at least 110 MPa, at least 120 MPa, at least 130 MPa, at least 140 MPa, at least 150 MPa, at least 160 MPa, at least 170 MPa, at least 180 MPa, at least 190 MPa, at least 200 MPa, at least 250 MPa, at least 300 MPa, at least 400 MPa, or at least 500 MPa. Additionally or alternatively, each explosive charge 520 may be sized such that the shockwave has a maximum duration of less than 1 second, less than 0.9 seconds, less than 0.8 seconds, less than 0.7 seconds, less than 0.6 seconds, less than 0.5 seconds, less than 0.4 seconds, less than 0.3 seconds, less than 0.2 seconds, less than 0.1 seconds, less than 0.05 seconds, or less than 0.01 seconds. The maximum duration may be a maximum period of time during which the shockwave has greater than the threshold shockwave intensity within the wellbore tubular. Additionally or alternatively, the maximum duration may be a maximum period of time during which the shockwave has a shockwave intensity of greater than 68.9 MPa (10,000 pounds per square inch) within any portion of the wellbore tubular.

Each explosive charge 520 additionally or alternatively may be sized such that the shockwave exhibits greater than the threshold shockwave intensity within the tubular conduit over a maximum effective distance, or length, of and/or along the tubular conduit. Examples of the maximum effective distance are disclosed herein.

As discussed, explosive charges 520 may be arranged on external surface 502 of core 500, may be wrapped around external surface 502 of core 500, and/or may extend at least partially within one or more flutes 504 that may be defined by external surface 502 of core 500. This may include explosive charges that extend longitudinally along the length of core 500, as illustrated in FIGS. 2-3, explosive charges that wrap and/or spiral along the length of the core, as illustrated in FIGS. 4-5, and/or explosive charges that encircle a transverse cross-section of the core, as illustrated in FIGS. 6-7.

Explosive charges 520 and core 500 may be oriented relative to one another such that, when shockwave generation device 190 is immersed within wellbore fluid 22, as illustrated in FIG. 1, the explosive charges extend at least partially between at least a portion of the core and the wellbore fluid. Stated yet another way, explosive charges 520 and core 500 may be oriented relative to one another such that, when shockwave generation device 190 is present within tubular conduit 42, as illustrated in FIG. 1, the explosive charges extend at least partially between external surface 502 and wellbore tubular 40.

Stated yet another way, and when the shockwave generation device is immersed within the wellbore fluid, at least a portion, or even a majority, of the explosive charges is exposed to the wellbore fluid, is in contact with the wellbore fluid, is in fluid contact with the wellbore fluid, and/or is not isolated from the wellbore fluid by the core. As examples, at least 50%, at least 60%, at least 70%, at least 80%, at least 90%, or at least 95% of a length of each of explosive charges 520 may be exposed to, in contact with, and/or in fluid contact with the wellbore fluid.

Shockwave generation device 190 may include any suitable number of explosive charges 520. As examples, the shockwave generation device may include at least 2, at least 3, at least 4, at least 5, at least 6, at least 7, or at least 8 explosive charges. Additionally or alternatively, the shockwave generation device may include 20 or fewer, 18 or fewer, 16 or fewer, 14 or fewer, 12 or fewer, 10 or fewer, 8 or fewer, 6 or fewer, or 4 or fewer explosive charges.

Triggering devices 530 may include and/or be any suitable structure that may be configured to selectively initiate explosion of selected ones of the plurality of explosive charges. As an example, triggering devices 530 may include and/or be electrically actuated triggering devices, separately addressable switches, and/or blast caps 532. As a more specific example, each triggering device 530 may include a uniquely addressable switch that may be configured to initiate explosion of a selected one of the plurality of explosive charges responsive to receipt of a unique code. The unique code of each triggering device may be different from the unique code of each of the other triggering devices, thereby permitting selective actuation of a given triggering device.

Each triggering device 530 may be configured to initiate explosion of a selected one of the plurality of explosive charges independent from a remainder of the explosive charges. Stated another way, each triggering device is configured to be actuated independently from a remainder of the triggering devices. Thus, shockwave generation device 190 may be configured such that actuation of a given triggering device initiates explosion of a corresponding explosive charge but does not, necessarily, result in actuation of another triggering device and/or initiate explosion of another explosive charge that is associated with the other triggering device.

As illustrated in FIGS. 2-4 and 6, triggering devices 530 may form a portion of a triggering assembly 528. Triggering assembly 528 may be operatively attached to core 500 and/or may form a portion of core 500. In addition, and when shockwave generation device 190 is submerged within the wellbore fluid, triggering assembly 528 may at least partially, or even completely, isolate at least a portion, or even all, of each triggering device 530 from the wellbore fluid. As an example, and as illustrated in FIGS. 2-3, triggering assembly 528 may include and/or define an enclosed volume 529 that is fluidly isolated from the wellbore fluid and/or that contains and/or houses the triggering devices.

As illustrated in dashed lines in FIGS. 2-3, 5, and 7, shockwave generation device 190 and/or explosive charge 520 thereof further may include a protective barrier 524. Protective barrier 524 may be configured to at least partially, or even completely, isolate, or fluidly isolate, explosive charges 520 from the wellbore fluid when the shockwave generation device is submerged within the wellbore fluid. Such isolation may prevent contamination of the explosive charge by the wellbore fluid, may prevent degradation of the explosive charge by the wellbore fluid, may resist permeation of the wellbore fluid into the explosive charge, and/or may resist abrasion of the explosive charge by an abrasive material, such as a proppant, that may be present within the wellbore fluid and/or by wellbore tubular 40 when the shockwave generation device is present within tubular conduit 42, as illustrated in FIG. 1.

As illustrated in FIG. 2, protective barrier 524 may extend along a length, or even an entire length, of explosive charge 520. As illustrated in FIG. 5 at 525, protective barrier 524 may extend at least partially, or even completely, around a transverse cross-section of a given explosive charge 520. Additionally or alternatively, and as illustrated in FIG. 5 at 526, protective barrier 524 may extend at least partially, or even completely, around a transverse cross-section of core 500 and/or of external surface 502 thereof.

It is within the scope of the present disclosure that shockwave generation device 190 may include a plurality of protective barriers 524 and that each protective barrier 524 may extend around a corresponding explosive charge 520, may extend along a length of the corresponding explosive charge, may extend along an entirety of the length of the corresponding explosive charge, and/or may extend across a respective portion of external surface 502 of core 500. Additionally or alternatively, it is also within the scope of the present disclosure that a single protective barrier 524 may extend at least partially around two or more of the explosive charges and/or may extend across a majority, or even all, of external surface 502 of core 500.

Protective barrier 524 may include and/or be formed from any suitable material. As examples, the protective barrier may include and/or be a non-metallic protective barrier and/or may be formed from a polymeric material, an elastomeric material, and/or a resilient material. As a more specific example, protective barrier 524 may include, or be, a resilient sleeve and/or cylinder that extends around at least one explosive charge 520 and/or that extends around external surface 502. As another more specific example, protective barrier 524 may include, or be, an adhesive tape that is taped to at least one explosive charge 520 and/or to external surface 502. As additional specific examples, protective barrier 524 may include, or be, a ceramic tube, or sleeve, that houses and/or contains one or more explosive charges 520 and/or at least a portion of core 500. As further examples, protective barrier 524 may include, or be, a hollow steel (or other metallic) carrier, or sleeve, that includes a plurality of ports, with the ports being present prior to explosion of the explosive charges and permitting the shockwave to exit the hollow steel carrier upon explosion of a given explosive charge 520.

As illustrated in solid lines in FIGS. 2-3, shockwave generation device 190 may include a first plurality of explosive charges 520 and a corresponding first plurality of triggering devices 530. In addition, and as illustrated in dashed lines in FIGS. 2-3, shockwave generation device 190 also may include a second plurality of explosive charges 520 and a corresponding second plurality of triggering devices 530. The first plurality of explosive charges and the first plurality of triggering devices together may define a first shockwave generation unit 198 (as indicated in solid lines), and the second plurality of explosive charges and the second plurality of triggering devices together may define a second shockwave generation unit 198 (as indicated in dashed lines).

The first shockwave generation unit and the second shockwave generation unit may be operatively attached to one another, in an end-to-end fashion, to form and/or define shockwave generation device 190. As an example, an end region of the first shockwave generation unit may be operatively attached to an end region of the second shockwave generation unit, such as via a coupling structure 562 and/or such that a longitudinal axis of the first shockwave generation unit is aligned, or at least substantially aligned, with a longitudinal axis of the second shockwave generation unit. Under these conditions, an overall, or collective, length of the first shockwave generation device in combination with the second shockwave generation device may be less than 10 meters, less than 8 meters, less than 6 meters, less than 5 meters, less than 4 meters, or less than 3 meters.

It is within the scope of the present disclosure that shockwave generation device 190 may include any suitable number of shockwave generation units 198 and that each shockwave generation unit 198 may include any suitable number of explosive charges 520 and corresponding triggering devices 530. As examples, shockwave generation device 190 may include at least 2, at least 3, at least 4, at least 5, at least 6, at least 8, or at least 10 shockwave generation units.

Shockwave generation device 190 may have any suitable length, or overall length. As examples, the overall length of the shockwave generation device may be less than 40 meters, less than 35 meters, less than 30 meters, less than 25 meters, or less than 20 meters. The shockwave generation device also may have any suitable maximum transverse cross-sectional extent, or area. As examples, the maximum transverse cross-sectional extent may be less than 0.2 meters (m), less than 0.15 m, less than 0.1 m, less than 0.8 m, less than 0.067 m, less than 0.06 m, or less than 0.05 m.

In order to provide clearance for motion of the shockwave generation device within the tubular conduit and/or to provide clearance for flow of ball sealers therepast, the maximum transverse cross-sectional extent of the shockwave generation device may be less than a cross-sectional diameter of the tubular conduit. As examples, the maximum transverse cross-sectional extent of the shockwave generation device may be at least 0.1 meter (m), at least 0.08 m, at least 0.06 m, at least 0.04 m, at least 0.031 m, at least 0.03 m, or at least 0.025 m less than the cross-sectional diameter of the tubular conduit.

As discussed, and illustrated in FIGS. 1-2, shockwave generation device 190 may include and/or be an umbilical-attached shockwave generation device 190 that is operatively attached to an umbilical 192. Such an umbilical may permit and/or facilitate positioning of the shockwave generation device within the tubular conduit and/or may permit and/or facilitate communication with the shockwave generation device, such as from surface region 30 of FIG. 1. As an example, umbilical 192 may convey one or more status signals from the shockwave generation device to the surface region and/or may convey one or more control signals from the surface region to the shockwave generation device. Such an umbilical-attached shockwave generation device may include an anchor 193 that may be configured to receive and/or to be operatively attached to the umbilical, as illustrated in FIG. 2.

As illustrated in FIGS. 2-4 and 6, shockwave generation device 190 further may include a detector 540. Detector 540 may be configured to detect any suitable property and/or parameter of shockwave generation device 190, of wellbore fluid 22, of wellbore tubular 40, and/or of tubular conduit 42 (as illustrated in FIG. 1). As an example, detector 540 may be configured to detect a location of the shockwave generation device within the wellbore tubular.

An example of detector 540 includes a casing collar locator that is configured to detect, or count, a casing collar of the wellbore tubular. Another example of detector 540 includes a magnetic field detector that is configured to detect a magnetic field that emanates from a magnetic material that defines a portion of the wellbore tubular and/or a selective stimulation port 100 of the wellbore tubular. Yet another example of detector 540 includes a radioactivity detector that is configured to detect a radioactive material that forms and/or defines a portion of the wellbore tubular and/or a selective stimulation port 100 of the wellbore tubular. Another example of detector 540 includes a depth detector that is configured to detect a depth of the shockwave generation device within the tubular conduit. Yet another example of detector 540 includes a speed detector that is configured to detect a speed of the shockwave generation device within the tubular conduit. Another example of detector 540 includes a timer that is configured to measure a time associated with motion of the shockwave generation device within the tubular conduit. Yet another example of detector 540 includes a downhole pressure sensor that is configured to detect a pressure within the wellbore fluid that is proximal thereto. Another example of detector 540 includes a downhole temperature sensor that is configured to detect a temperature within the wellbore fluid.

As illustrated in dashed lines in FIGS. 2-4, and 6, shockwave generation device 190 further may include a controller 550. Controller 550 may be adapted, configured, designed, constructed, and/or programmed to control the operation of at least a portion of the shockwave generation device. This control may be based, at least in part, on the property and/or parameter that is detected by detector 540. As an example, and as illustrated in FIG. 3, shockwave generation device 190 may include a communication linkage 552 between controller 550 and detector 540.

As an example, detector 540 may be configured to generate a location signal that is indicative of the location of the shockwave generation device within the wellbore tubular and to convey the location signal to the controller via the communication linkage. In addition, the controller may be programmed to control the operation of the shockwave generation device based, at least in part, on the location signal. As a more specific example, controller 550 may be programmed to actuate a selected one of the plurality of triggering devices 530 based, at least in part, on the location signal and/or responsive to receipt of the location signal. The triggering device then may initiate explosion of a corresponding one of the plurality of explosive charges 520.

As another example, detector 540 may be configured to detect a pressure pulse within the wellbore fluid, such as may be deliberately and/or purposefully generated within the wellbore fluid by an operator of the hydrocarbon well. Under these conditions, detector 540 may generate a pressure pulse signal responsive to receipt of the pressure pulse and may provide the pressure pulse signal, via the communication linkage, to controller 550. Controller 550 then may be programmed to actuate the selected one of the plurality of triggering devices 530 based, at least in part, on the pressure pulse signal and/or responsive to receipt of the pressure pulse signal.

Additionally or alternatively, controller 550 may be configured to actuate the selected one of the plurality of triggering devices responsive to receipt of a triggering signal. The triggering signal may be provided to the controller in any suitable manner. As an example, and as illustrated in FIG. 1, wellbore 20 may include a downhole wireless communication network 39, and controller 550 may be adapted, configured, designed, constructed, and/or programmed to receive the triggering signal from the downhole wireless communication network. As another example, and as also illustrated in FIG. 1, shockwave generation device 190 may be an umbilical-attached shockwave generation device that is attached to an umbilical 192. Under these conditions, controller 550 may be adapted, configured, designed, constructed, and/or programmed to receive the triggering signal from the umbilical, and it is within the scope of the present disclosure that the umbilical may be configured to provide serial communication between the controller and surface region 30.

Controller 550 may include any suitable structure. As examples, controller 550 may include and/or be a special-purpose controller, an analog controller, a digital controller, and/or a logic device.

As illustrated in dashed lines in FIG. 2, and in solid lines in FIGS. 4 and 6, shockwave generation device 190 further may include a guide structure 560. Guide structure 560 may be adapted, configured, sized, and/or shaped to passively guide and/or direct the shockwave generation device when the shockwave generation device moves and/or translates within the tubular conduit.

As also illustrated in dashed lines in FIG. 2, shockwave generation device 190 may include a bridge plug setting structure 566. Bridge plug setting structure 566 may be configured to set, or to selectively set, a bridge plug within the tubular conduit.

As also illustrated in dashed lines in FIG. 2, shockwave generation device 190 may include a ball sealer holder 580. Ball sealer holder 580 may contain and/or house one or more ball sealers 582 and may be configured to selectively release the one or more ball sealers. As an example, ball sealer holder 580 may be configured to selectively release at least one ball sealer for each explosive charge 520 that is associated with shockwave generation device 190 and/or for each selective stimulation port that is opened by each explosive charge. This may include releasing the at least one ball sealer responsive to explosion of a corresponding explosive charge 520, prior to explosion of the corresponding explosive charge, and/or subsequent to explosion of the corresponding explosive charge.

As illustrated in dashed lines in FIG. 2, shockwave generation device 190 further may include and/or have operatively attached thereto one or more weights 564. Weights 564 may be configured to increase an average density of the shockwave generation device, to increase a weight of the shockwave generation device, and/or to regulate an orientation of the shockwave generation device when the shockwave generation device is present within the wellbore conduit. As an example, and as illustrated in FIG. 2, weights 564 may be oriented off-center with respect to a transverse cross-section of shockwave generation device 190 and thereby may cause the shockwave generation device to orient within the wellbore conduit in a predetermined, or desired, manner.

It is within the scope of the present disclosure that, subsequent to actuation of explosive charges 520, shockwave generation device 190 may be adapted, configured, designed, and/or constructed to break apart and/or to dissolve within the tubular conduit. As an example, shockwave generation device 190 may be formed from a frangible material that breaks apart responsive to explosion of a last, or final, explosive charge 520.

As another example, shockwave generation device 190 may be formed from a corrodible material that corrodes within the wellbore fluid. This may include corroding within a timeframe that is shorter than a timeframe for other components of the hydrocarbon well, such as wellbore tubular 40. As an example, the shockwave generation device may be configured to remain intact during generation of the shockwaves and to corrode, completely corrode, and/or break apart between completion of stimulation operations that utilize the shockwave generation device and initiation of production of the reservoir fluid from the hydrocarbon well.

As yet another example, shockwave generation device 190 may be formed from a soluble material that is soluble within the wellbore fluid. This soluble material may be selected to dissolve within a timeframe that is shorter than the timeframe for other components of the hydrocarbon well, such as wellbore tubular 40, to corrode and/or break apart. As an example, the shockwave generation device may be configured to remain intact during generation of the shockwaves and to dissolve, completely dissolve, and/or break apart between completion of stimulation operations that utilize the shockwave generation device and initiation of production of the reservoir fluid from the hydrocarbon well.

As discussed in more detail herein, shockwave generation device 190 may be configured to generate the shockwave to transition a selective stimulation port, such as SSP 100 of FIG. 1, from a closed state to an open state, to permit stimulation of a subterranean formation, such as subterranean formation 34 of FIG. 1, and/or to permit an inrush of fluid into the wellbore tubular from the subterranean formation. Under these conditions, shockwave generation device 190 may be adapted, configured, designed, constructed, and/or sized to remain in the tubular conduit during stimulation of the subterranean formation, during flow of a stimulant fluid through and/or within the tubular conduit and past the shockwave generation device, and/or during the inrush of fluid into the wellbore tubular.

Figure 9:
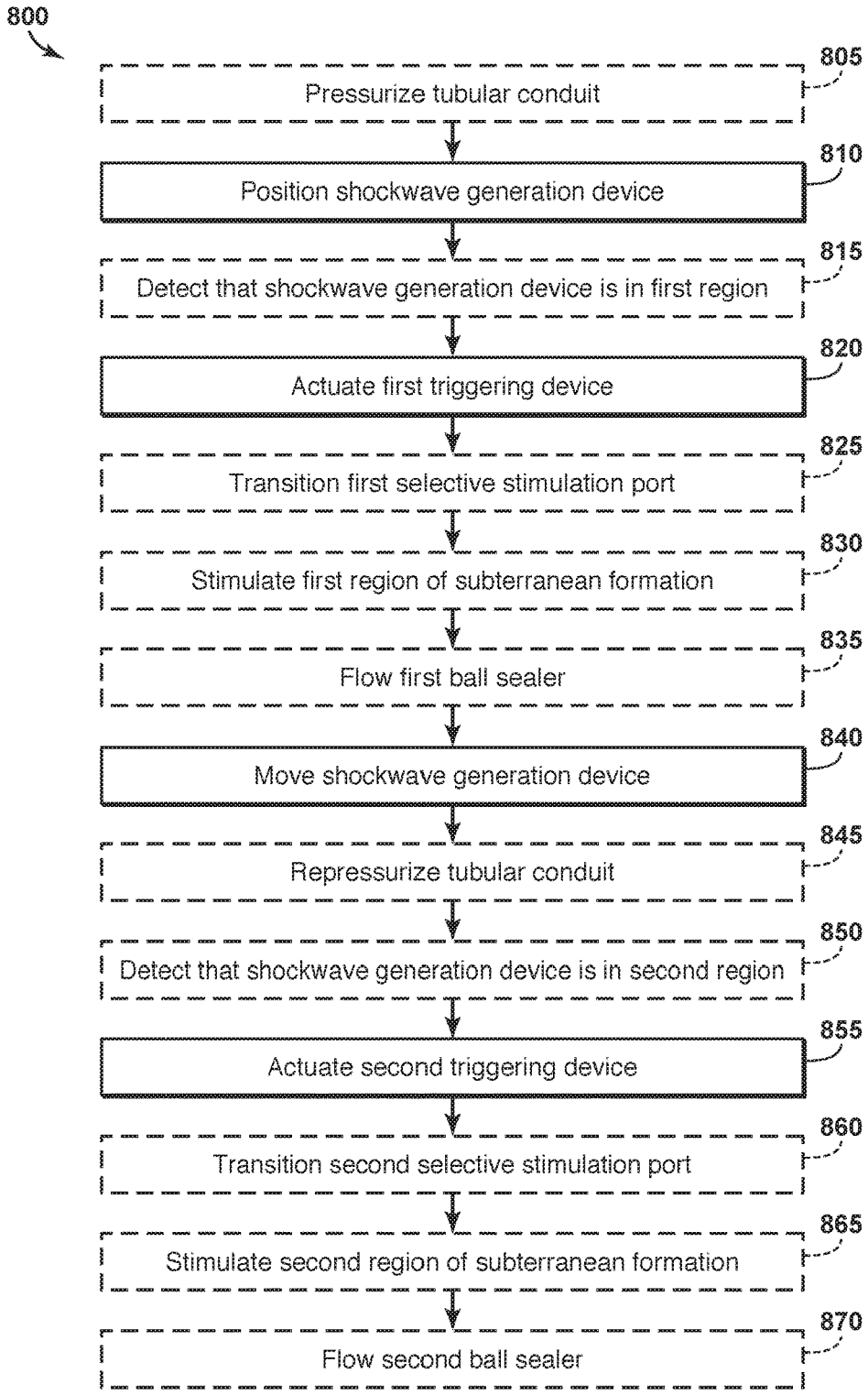
FIG. 9 is a flowchart depicting methods, according to the present disclosure, of generating a plurality of shockwaves within a wellbore fluid that extends within a tubular conduit.

FIG. 9 is a flowchart depicting methods 800, according to the present disclosure, of generating a plurality of shockwaves within a wellbore fluid that extends within a tubular conduit, while FIGS. 10-14 are schematic cross-sectional views of a portion of a process flow 340 for generating a plurality of shockwaves 194 within a subterranean formation 34. As illustrated in process flow 340 of FIGS. 10-14, a shockwave generation device 190 may be positioned within a wellbore tubular 40 that defines a tubular conduit 42 and extends within subterranean formation 34. The wellbore tubular may include a plurality of selective stimulation ports (SSPs) 100 that initially may be in a closed state 121. The plurality of SSPs 100 may be spaced apart along the wellbore tubular, such as along the longitudinal length of the wellbore tubular and/or radially around the circumference of the wellbore tubular.

Methods 800 may include pressurizing the tubular conduit at 805 and include positioning the shockwave generation device at 810. Methods 800 further may include detecting that the shockwave generation device is within a first region of the tubular conduit at 815 and include actuating a first triggering device at 820. Methods 800 further may include transitioning a first selective stimulation port at 825, stimulating a first region of the subterranean formation at 830, and/or flowing a first ball sealer at 835. Methods 800 include moving the shockwave generation device at 840 and may include repressurizing the tubular conduit at 845 and/or detecting that the shockwave generation device is in a second region of the tubular conduit at 850. Methods 800 further include actuating a second triggering device at 855 and may include transitioning a second selective stimulation port at 860, stimulating a second region of the subterranean formation at 865, and/or flowing a second ball sealer at 870.

Figure 10:
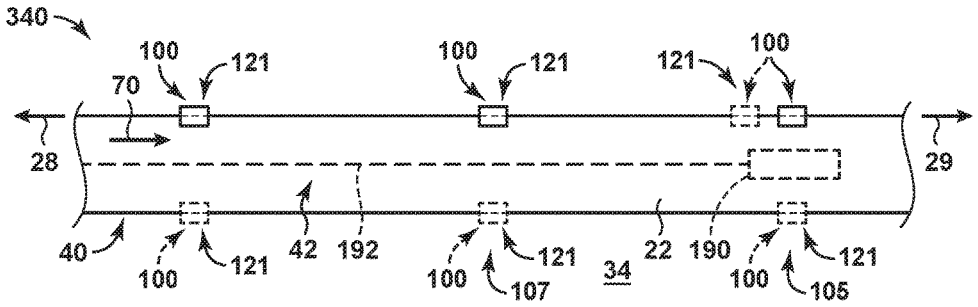
FIG. 10 is a schematic cross-sectional view of a portion of a process flow for generating a plurality of shockwaves within a subterranean formation.

Pressurizing the tubular conduit at 805 may include pressurizing the tubular conduit in any suitable manner. As an example, the pressurizing at 805 may include pressurizing with a stimulant fluid, such as by flowing the stimulant fluid into the tubular conduit and/or providing the stimulant fluid to the tubular conduit. The pressurizing at 805 may be prior to the positioning at 810, concurrently with the positioning at 810, subsequent to the positioning at 810, prior to the detecting at 815, concurrently with the detecting at 815, subsequent to the detecting at 815, and/or prior to the actuating at 820. The pressurizing at 805 is illustrated in FIG. 10, wherein a stimulant fluid 70 is provided to tubular conduit 42 of wellbore tubular 40. As also illustrated in FIG. 10, and during the pressurizing at 805, SSPs 100 associated with wellbore tubular 40 may be in closed state 121, thereby permitting pressurization of the tubular conduit.

Positioning the shockwave generation device at 810 may include positioning any suitable shockwave generation device, including shockwave generation device 190 of FIGS. 2-8 and 10-14, within the first region of the tubular conduit. This is illustrated in FIG. 10, with shockwave generation device 190 being positioned within first region 105 of tubular conduit 42.

The positioning at 810 may be accomplished in any suitable manner. As an example, the positioning at 810 may include flowing and/or conveying the shockwave generation device in a downhole direction, such as downhole direction 29 of FIG. 10, within a flow of the stimulant fluid. As another example, the positioning at 810 may include positioning with an umbilical, such as a wireline, as illustrated in FIG. 10 at 192. As yet another example, the positioning at 810 may include autonomously positioning the shockwave generation device. As another example, the positioning at 810 may include landing, resting, stopping, and/or receiving the shockwave generation device on and/or with any suitable latch, catch, receiver, and/or platform that may form a portion of the wellbore tubular and/or of the SSP, and/or that may extend within the tubular conduit.

Detecting that the shockwave generation device is within the first region of the tubular conduit at 815 may include detecting in any suitable manner. As an example, the detecting at 815 may include detecting via and/or utilizing detector 540 of FIGS. 2-3. Additionally or alternatively, the detecting at 815 may include one or more of detecting a casing collar of the wellbore tubular, detecting a velocity of the shockwave generation device within the wellbore tubular, detecting a residence time of the shockwave generation device within the wellbore tubular, detecting a distance of flow of the shockwave generation device along the length of the wellbore tubular, detecting a depth of the shockwave generation device within the wellbore tubular, detecting a magnetic material that forms a portion of the wellbore tubular and/or SSP, and/or detecting a radioactive material that forms a portion of the wellbore tubular and/or SSP.

Figure 11:
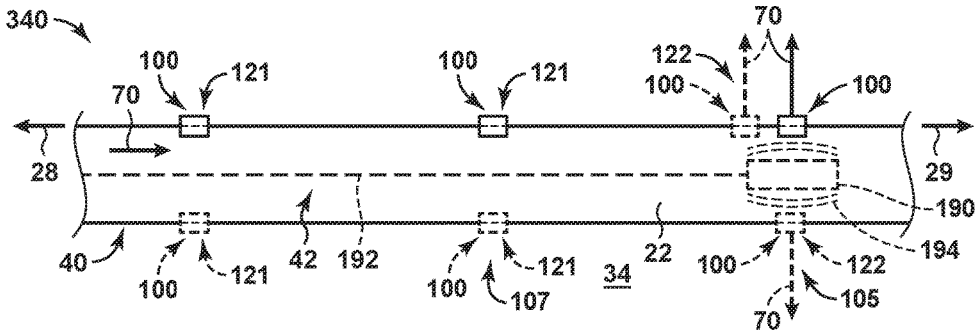
FIG. 11 is a schematic cross-sectional view of a portion of a process flow for generating a plurality of shockwaves within a subterranean formation.

Actuating the first triggering device at 820 may include actuating the first triggering device to initiate explosion of a first explosive charge of a plurality of explosive charges of the shockwave generation device. Additionally or alternatively, the actuating at 820 may include actuating to generate a first shockwave within the first region of the tubular conduit. This is illustrated in FIG. 11, where a shockwave 194 is illustrated within first region 105 of tubular conduit 42.

It is within the scope of the present disclosure that the actuating at 820 may include actuating responsive to any suitable criteria. As an example, the actuating at 820 may be initiated responsive to the detecting at 815 (i.e., responsive to detecting that the shockwave generation device is within the first region of the tubular conduit). As another example, the actuating at 820 may include actuating subsequent to the positioning at 810 and/or responsive to completion of the positioning at 810.

It is also within the scope of the present disclosure that the actuating at 820 may include actuating in any suitable manner. As examples, the actuating at 820 may include electrically actuating, mechanically actuating, chemically actuating, wirelessly actuating, and/or actuating responsive to receipt of a pressure pulse.

Transitioning the first selective stimulation port at 825 may include transitioning one or more first selective stimulation ports (SSP) from respective closed states to respective open states responsive to receipt of the first shockwave with greater than the threshold shockwave intensity by the one or more first SSPs. When in the closed state, the SSPs resist fluid flow therethrough, while, when in the open state, the SSPs permit fluid flow therethrough.

This is illustrated in FIG. 11, with first SSPs 100 that are present within first region 105 of tubular conduit 42 being transitioned to open state 122 responsive to receipt of shockwave 194. As also illustrated in FIG. 11, the transitioning at 825 further may include transitioning the first SSP 100 to open state 122 while maintaining one or more second SSPs 100 that are uphole from the first SSP in respective closed states 121. The first SSPs and the second SSPs also may be referred to herein as being spaced-apart, or longitudinally spaced-apart, along a length of the wellbore tubular, and this selective transitioning of the first SSP and not the other SSPs may be due to the limited, or maximum, effective distance, or propagation distance, of the shockwave within a wellbore fluid 22 that extends within tubular conduit 42, as is discussed herein. Examples of the maximum effective distance of the shockwave are disclosed herein, and the one or more first SSPs and the one or more second SSPs may be spaced-apart by greater than the maximum effective distance of the shockwave.

Stimulating the first region of the subterranean formation at 830 may include stimulating any suitable first region of the subterranean formation that may be proximal to and/or associated with the first region of the tubular conduit. The stimulating at 830 may include stimulating responsive to, or directly responsive to, the actuating at 820 and/or the transitioning at 825. As an example, and as illustrated in FIG. 11, transitioning the one or more first SSPs 100 to open state 122 may permit stimulant fluid 70 to flow from tubular conduit 42 and into subterranean formation 34, thereby permitting stimulation of the subterranean formation.

Flowing the first ball sealer at 835 may include providing one or more first ball sealers from the surface region and flowing the one or more first ball sealers, via the tubular conduit, to, into contact with, or into engagement with, the one or more first SSPs and/or with one or more sealing device seats 140 thereof. Additionally or alternatively, the flowing at 835 may include releasing the one or more first ball sealers from the shockwave generation device and flowing the one or more first ball sealers, via the tubular conduit, to and/or into engagement with the one or more first SSPs. Engagement between the one or more first ball sealers and the one or more first SSPs may restrict fluid flow from the tubular conduit via the one or more first SSPs.

Figure 12:
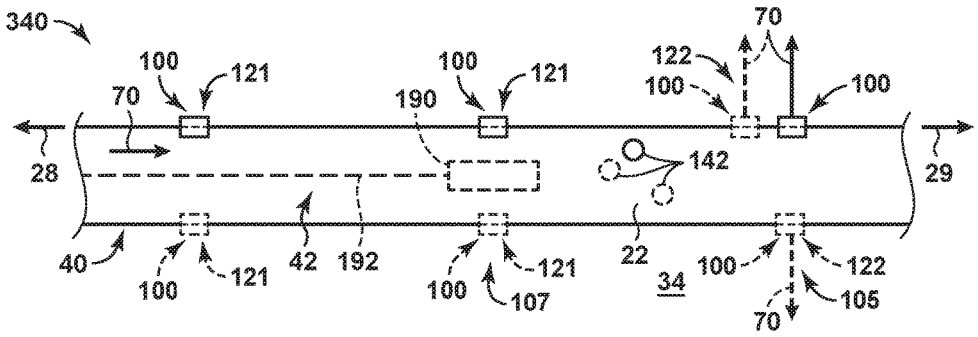
FIG. 12 is a schematic cross-sectional view of a portion of a process flow for generating a plurality of shockwaves within a subterranean formation.
Figure 13:
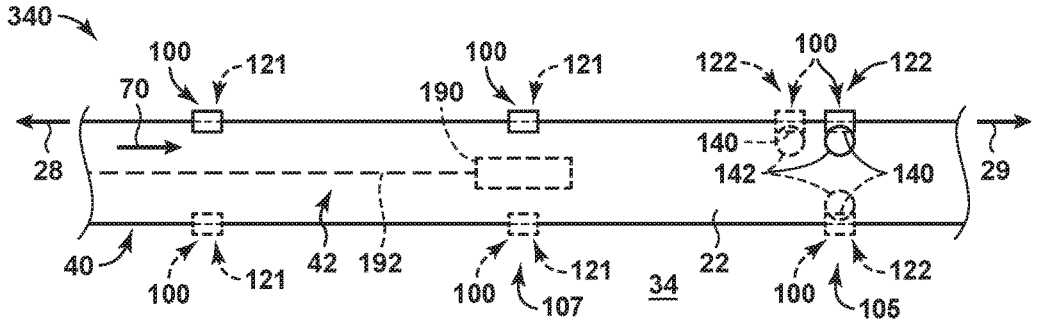
FIG. 13 is a schematic cross-sectional view of a portion of a process flow for generating a plurality of shockwaves within a subterranean formation.

This is illustrated in FIGS. 12-13. In FIG. 12, sealing devices 142 in the form of ball sealers are depicted as flowing within a flow of stimulant fluid 70 in downhole direction 29 within tubular conduit 42. In FIG. 13, the ball sealers have engaged with the one or more first SSPs that are present within first region 105 of the tubular conduit and restrict fluid flow therethrough.

The flowing at 835 may be performed with any suitable timing and/or sequence within methods 800. As an example, the flowing at 835 may be performed subsequent to the pressurizing at 805, subsequent to the positioning at 810, subsequent to the detecting at 815, subsequent to the actuating at 820, subsequent to the transitioning at 825, and/or subsequent to the stimulating at 830. Additionally or alternatively, and when the pressurizing at 805 includes providing the stimulant fluid to the tubular conduit, the flowing at 835 may be performed at least partially concurrently with the providing.

Moving the shockwave generation device at 840 may include moving the shockwave generation device to a second region of the tubular conduit that is spaced-apart from the first region of the tubular conduit. It is within the scope of the present disclosure that the moving at 840 may be accomplished in any suitable manner. As an example, the moving at 840 may include moving with, via, and/or utilizing an umbilical, such as a wireline. As a more specific example, and as illustrated in the transition from FIG. 12 to FIG. 13, the moving at 840 may include moving shockwave generation device 190 in an uphole direction 28 such that the shockwave generation device is within a second region 107 of tubular conduit 42.

Repressurizing the tubular conduit at 845 may include repressurizing with the stimulant fluid. The repressurizing at 845 may be performed at least substantially similar to the pressurizing at 805. It is within the scope of the present disclosure that, when the pressurizing at 805 includes flowing and/or providing the stimulant fluid to the tubular conduit, the flowing and/or providing may be performed continuously, or at least substantially continuously, during a remainder of methods 800. Under these conditions, the repressurizing at 845 may be responsive to, or a result of, operative engagement between the one or more first ball sealers and the one or more first SSPs, as accomplished during the flowing at 835.

The repressurizing at 845 may be performed with any suitable timing and/or sequence within methods 800. As examples, the repressurizing at 845 may be performed subsequent to the flowing at 835 and prior to the actuating at 855.

Detecting that the shockwave generation device is in the second region of the tubular conduit at 850 may include detecting in any suitable manner. As an example, the detecting at 850 may be similar, or at least substantially similar, to the detecting at 815.

Figure 14:
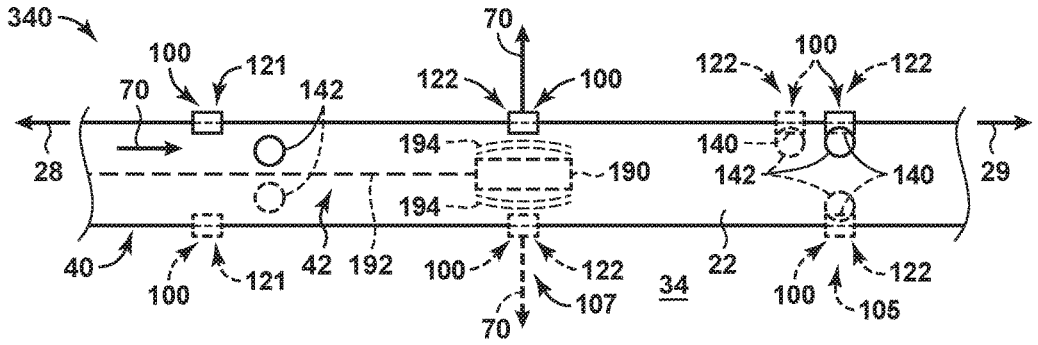
FIG. 14 is a schematic cross-sectional view of a portion of a process flow for generating a plurality of shockwaves within a subterranean formation.

Actuating the second triggering device at 855 may include actuating to initiate explosion of a second explosive charge and/or to generate a second shockwave within the second region of the tubular conduit. The actuating at 855 may be performed in any suitable manner and may be similar, or at least substantially similar, to the actuating at 820 and may be responsive, or at least partially responsive, to the detecting at 850. The actuating at 855 is illustrated in FIG. 14. Therein, shockwave generation device 190 is present within second region 107 of tubular conduit 42 and has initiated explosion of a second explosive charge to generate a second shockwave 194 within wellbore fluid 22 that extends within the tubular conduit.

Transitioning the second selective stimulation port at 860 may include transitioning one or more second SSPs from respective closed states to respective open states responsive to receipt of the second shockwave with greater than the threshold shockwave intensity by the one or more second SSPs. In general, the transitioning at 860 may be at least substantially similar to the transitioning at 825, which is discussed herein. The transitioning at 860 is illustrated in FIG. 14. Therein, one or more second SSPs 100 that are present within second portion 107 of tubular conduit 42 are transitioned to respective open states 122 responsive to receipt of shockwave 194.

Stimulating the second region of the subterranean formation at 865 may include stimulating any suitable second region of the subterranean formation that is proximal to and/or associated with the second region of the tubular conduit. The stimulating at 865 may be at least substantially similar to the stimulating at 830 and may be responsive to, or directly responsive to, the actuating at 855 and/or the transitioning at 860. The stimulating at 865 is illustrated in FIG. 14, with stimulant fluid 70 flowing from tubular conduit 42 into subterranean formation 34 via the one or more second SSPs 100 that are present within second region 107 of the tubular conduit.

The stimulating at 865 may be performed with any suitable timing and/or sequence within methods 800. As examples, the stimulating at 865 may be performed subsequent to the flowing at 835, subsequent to the moving at 840, subsequent to the repressurizing at 845, subsequent to the detecting at 850, and/or prior to the flowing at 870.

Flowing the second ball sealer at 870 may be at least substantially similar to the flowing at 835, which is discussed herein. As an example, the flowing at 870 may include providing one or more second ball sealers from the surface region and flowing the one or more second ball sealers, via the tubular conduit, to, into contact with, or into engagement with, the one or more second SSPs and/or with one or more sealing device seats 140 thereof. As another example, the flowing at 835 may include releasing the one or more second ball sealers from the shockwave generation device and flowing the one or more second ball sealers, via the tubular conduit, to and/or into engagement with the one or more second SSPs.

The flowing at 870 may be performed with any suitable timing and/or sequence within methods 800. As an example, the flowing at 870 may be performed subsequent to the moving at 840, subsequent to the repressurizing at 845, subsequent to the detecting at 850, subsequent to the actuating at 855, subsequent to the transitioning at 860, and/or subsequent to the stimulating at 865.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The select-fire downhole shockwave generation devices, hydrocarbon wells, and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A select-fire, downhole shockwave generation device configured to generate a shockwave within a wellbore fluid extending within a tubular conduit, wherein the tubular conduit is defined by a wellbore tubular that extends within a wellbore, the device comprising:

a core;

a plurality of explosive charges arranged on an external surface of the core; and a plurality of triggering devices, wherein each of the plurality of triggering devices is configured to selectively initiate explosion of a selected one of the plurality of explosive charges;

wherein the plurality of explosive charges is sized such that the shockwave exhibits greater than a threshold shockwave intensity within the tubular conduit over a maximum effective distance of 4 meters along a length of the tubular conduit.

2. The device of claim 1, wherein the core includes a metallic rod, and further wherein the plurality of explosive charges includes a plurality of lengths of primer cord wrapped around the external surface of the metallic rod.

3. The device of claim 1, wherein the plurality of explosive charges is a first plurality of explosive charges, wherein the plurality of triggering devices is a first plurality of triggering devices, wherein the first plurality of explosive charges and the first plurality of triggering devices together define a first shockwave generation unit, and wherein the shockwave generation device further includes a second shockwave generation unit that includes a second plurality of explosive charges and a second plurality of triggering devices, and further wherein an end region of the first shockwave generation unit is operatively attached to an end region of the second shockwave generation unit such that a longitudinal axis of the first shockwave generation unit is aligned with a longitudinal axis of the second shockwave generation unit.

4. The device of claim 1, wherein the core includes at least one of:

(i) an elongate core;

(ii) a rigid core;

(iii) a metallic core;

(iv) a solid core; and (v) an elongate rigid rod.

5. The device of claim 1, wherein the core includes a plurality of flutes, and further wherein each of the plurality of flutes at least partially contains a respective one of the plurality of explosive charges.

6. The device of claim 5, wherein the external surface of the core defines each of the plurality of flutes.

7. The device of claim 5, wherein each of the plurality of flutes includes a respective recess, which is defined by the core, and an opening that provides access to the recess, and wherein the recess is an elongate recess, and wherein the opening is an elongate opening and further wherein a respective explosive charge extends within each recess and does not project through the opening.

8. The device of claim 5, wherein the plurality of flutes includes a plurality of spiraling flutes that spirals along a longitudinal axis of the core.

9. The device of claim 5, wherein the plurality of flutes includes a plurality of circumferential flutes, wherein each of the plurality of circumferential flutes extends at least partially around a transverse cross section of the core.

10. The device of claim 1, wherein, when the downhole shockwave generation device is immersed within the wellbore fluid, at least a portion of each of the plurality of explosive charges is exposed to the wellbore fluid.

11. The device of claim 1, wherein the plurality of explosive charges includes a plurality of lengths of primer cord.

12. The device of claim 11, wherein each of the plurality of lengths of primer cord has a corresponding length between 0.5 meters and 3 meters.

13. The device of claim 11, wherein each of the plurality of lengths of primer cord includes 100 to 800 grains of gunpowder per meter of length.

14. The device of claim 1, wherein the shockwave generation device further includes a protective barrier configured to at least partially isolate each of the plurality of explosive charges from the wellbore fluid.

15. The device of claim 1, wherein the plurality of triggering devices includes a plurality of blast caps.

16. The device of claim 1, wherein each of the plurality of triggering devices is configured to initiate explosion of the selected one of the plurality of explosive charges independent from a remainder of the plurality of explosive charges.

17. The device of claim 1, wherein the plurality of triggering devices forms a portion of a triggering assembly that is operatively attached to the core.

18. The device of claim 17, wherein each of the plurality of triggering devices includes a uniquely addressed switch configured to initiate explosion of the selected one of the plurality of explosive charges responsive to receipt of a unique code, wherein a unique code of each of the plurality of triggering devices is different from a unique code of a remainder of the plurality of triggering devices.

19. The device of claim 1, wherein the plurality of explosive charges is sized such that the shockwave has sufficient energy to transition a first selective stimulation port, which is operatively attached to the wellbore tubular and less than 2 meters from the shockwave generation device when the shockwave generation device generates the shockwave, from a closed state to an open state but insufficient energy to transition a second selective stimulation port, which is operatively attached to the wellbore tubular and greater than 2 meters from the shockwave generation device when the shockwave generation device generates the shockwave, from the closed state to the open state.

20. The device of claim 1, wherein the shockwave generation device further includes a detector and further wherein the detector is configured to detect a location of the shockwave generation device within the wellbore tubular.

21. The device of claim 20, wherein the detector includes at least one of:

(i) a casing collar detector configured to detect a casing collar of the wellbore tubular;

(ii) a magnetic field detector configured to detect a magnetic field that emanates from a magnetic material that defines a portion of the wellbore tubular;

(iii) a radioactivity detector configured to detect a radioactive material that defines a portion of the wellbore tubular;

(iv) a depth detector configured to detect a depth of the shockwave generation device within the tubular conduit;

(v) a speed detector configured to detect a speed of the shockwave generation device within the tubular conduit;

(vi) a timer configured to measure a time associated with motion of the shockwave generation device within the tubular conduit;

(vii) a downhole pressure sensor configured to detect a pressure within the wellbore fluid that is proximal thereto; and (viii) a downhole temperature sensor configured to detect a temperature within the wellbore fluid that is proximal thereto.

22. The device of claim 20, wherein the shockwave generation device further includes a controller programmed to control an operation of the shockwave generation device.

23. The device of claim 22, wherein the shockwave generation device includes a communication linkage between the controller and the detector, wherein the detector is configured to generate a location signal indicative of the location of the shockwave generation device within the wellbore tubular and to convey the location signal to the controller via the communication linkage, and further wherein the controller is programmed to control the operation of the shockwave generation device based, at least in part, on the location signal, and wherein the controller is programmed to actuate a selected one of the plurality of triggering devices to initiate explosion of a corresponding one of the plurality of explosive charges based, at least in part, on the location signal.

24. The device of claim 22, wherein the controller is programmed to actuate a selected one of the plurality of triggering devices to initiate explosion of a corresponding one of the plurality of explosive charges responsive to receipt of a triggering signal, and wherein the wellbore includes a downhole wireless communication network.

25. The device of claim 22, wherein the controller is programmed to receive a triggering signal from a downhole wireless communication network, and wherein the shockwave generation device is an umbilical-attached shockwave generation device attached to an umbilical, and further wherein the controller is programmed to receive the triggering signal via the umbilical.

26. The device of claim 1, wherein the shockwave generation device further includes a ball sealer holder configured to selectively release a ball sealer.

27. A method of generating a plurality of shockwaves within a wellbore fluid extending within a tubular conduit, wherein the tubular conduit is defined by a wellbore tubular that extends within a wellbore, the method comprising:

positioning the select-fire, downhole shockwave generation device of claim 1 within a first region of the tubular conduit;

actuating a first triggering device of the plurality of triggering devices to initiate explosion of a first explosive charge of the plurality of explosive charges and to generate a first shockwave within the first region of the tubular conduit;

moving the shockwave generation device to a second region of the tubular conduit that is spaced-apart from the first region of the tubular conduit; and actuating a second triggering device of the plurality of triggering devices to initiate explosion of a second explosive charge of the plurality of explosive charges and to generate a second shockwave within the second region of the tubular conduit;

wherein the wellbore tubular includes a plurality of selective stimulation ports (SSPs) including a first SSP and a second SSP, wherein each of the plurality of SSPs is configured to transition from a respective closed state, in which the SSP resists fluid flow therethrough, to an open state, in which the SSP permits fluid flow therethrough, responsive to receipt of a respective shockwave, wherein the method includes transitioning the first SSP from a closed state to an open state responsive to receipt of the first shockwave by the first SSP, and further wherein the method includes transitioning the second SSP from the closed state to the open state responsive to receipt of the second shockwave by the second SSP.

28. The method of claim 27, wherein the method further includes detecting that the shockwave generation device is within the first region of the tubular conduit, and wherein the actuating the first triggering device is at least partially responsive to the detecting that the shockwave generation device is within the first region of the tubular conduit, and wherein the method further includes detecting that the shockwave generation device is within the second region of the tubular conduit, and further wherein the actuating the second triggering device is at least partially responsive to the detecting that the shockwave generation devices is within the second region of the tubular conduit.

29. The method of claim 27, wherein, prior to the actuating the first triggering device, the method further includes pressurizing the tubular conduit with a stimulant fluid, and further wherein the method includes stimulating a first region of a subterranean formation, which is proximal the first region of the tubular conduit, responsive to the actuating the first triggering device.

* * * * *